United States Patent [19]

Yoshieda et al.

[11] 4,437,233

[45] Mar. 20, 1984

[54] FASTENER SLIDER HOLDING DEVICE

[75] Inventors: Keiichi Yoshieda; Yoshitaka Iimura, both of Toyama, Japan

[73] Assignee: Yoshida Kogyo K. K., Tokyo, Japan

[21] Appl. No.: 283,107

[22] Filed: Jul. 13, 1981

[30] Foreign Application Priority Data

Aug. 8, 1980 [JP] Japan ..... 55-112489

[51] Int. Cl.[3] ..... A21H 37/06

[52] U.S. Cl. ..... 29/768; 29/408; 29/409; 29/767; 74/99 A; 74/107

[58] Field of Search ..... 29/408, 409, 766, 767, 29/768; 74/107, 99 A, 99 R

[56] References Cited

U.S. PATENT DOCUMENTS 3,812,571 5/1974 Dori ..... 29/768

3,844,014 10/1974 Takahashi et al. ..... 29/768

3,939,543 2/1976 Yoshida ..... 29/768

3,956,813 5/1976 Shigeno ..... 29/768

3,964,615 6/1976 Silvis et al. ..... 29/409

*Primary Examiner*—Ervin M. Combs

*Assistant Examiner*—Steven E. Nichols

*Attorney, Agent, or Firm*—Hill, Van Santen, Steadman & Simpson

[57] ABSTRACT

A fastener slider holding device comprising a slider holder having a slider mount on the top and a pull tab receiving recess in one side thereof, a spring-loaded sliding member mounted in the slider holder for vertical movement, a slider holding lever having an engaging pawl at the upper end thereof for engaging the pull tab of a fastener slider, an operation rod for moving the sliding member vertically and cam means for moving the slider holding lever between the pull tab engaging and disengaging positions.

6 Claims, 7 Drawing Figures

FASTENER SLIDER HOLDING DEVICE

BACKGROUND OF THE INVENTION

This invention relates to a fastener slider holding device which is adapted to be employed for attaching fastener chains to a fastener slider when a slide fastener is subjected to finishing process or the slide fastener is sewn onto a clothing article.

A variety of fastener slider holding devices have been proposed, but in most of the previously proposed fastener slider holding devices, since the slider mount of the slider holder is formed with a downwardly slanted groove or recess in which the pull tab of a fastener slider hangs down, when the fastener slider is fed to the slider mount, it is required that the pull tab be dropped into the groove or recess at a downwardly slanted angle. Thus, the slider feed device associated with the slider holding device is also required to have a complicated mechanism which is adapted to grip a fastener slider in a position above the slider mount and move the slider downwardly to the slider mount where the slider is set. Such type of fastener slider holding device is disclosed, for example, in Japanese Patent Publication No. 2028/76, 7420/76, 28057/77 and 28422/77. It has been also proposed to form a pull tab receiving recess in one side of the slider holder (refer to Japanese Patent Laid-Open No. 91306/1980, for example). However, since a pull tab engaging piece of the slider holder always extends to a position where the engaging piece engages in the hole in the pull tab hanging down within the tab receiving recess, the pull tab engaging piece is always engaged in the hole in the pull tab when the tab is set on the slider mount. Therefore, after the fastener chains have been threaded through the fastener slide, when the slider assembly is taken out of the slider holding device, the pull tab is required to be disengaged from the pull tab engaging piece by pulling the tab forwardly of the engaging piece to thereby place limitation on the automatic removal of the slider assembly.

SUMMARY OF THE INVENTION

Therefore, the present invention is to provide a fastener slider holding device which can effectively eliminate the disadvantages inherent in the conventional fastener slider holding devices referred to hereinabove.

The purpose of the present invention is to provide a fastener slider holding device which requires a relatively simple slider feed means and which can perform the slider feed and removal operation following the movement of the fastener chains in a simple manner to thereby easily attain automatic slider feed and removal.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

Figure 1:
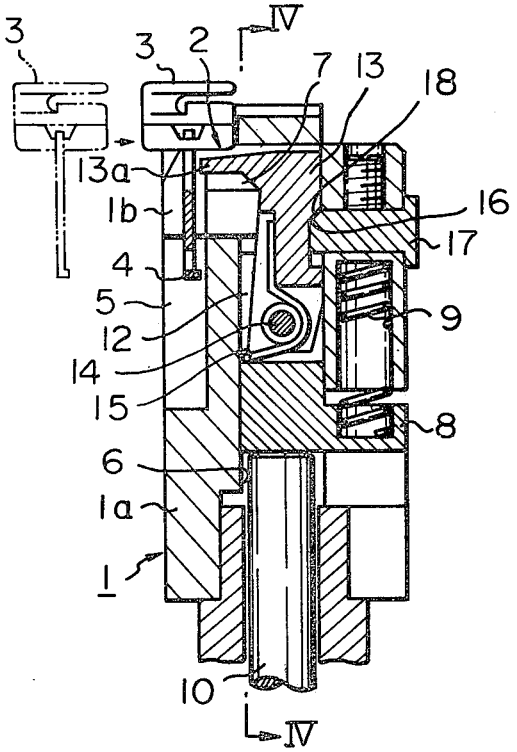
FIG. 1 is a vertically sectional view of one preferred embodiment of the slider holding device constructed in accordance with the present invention.

The present invention will be now described referring to the accompanying drawings. Numeral 1 denotes a slider holder which comprises a lower block 1*a* and an upper block 1*b* attached to the lower block 1*a* and having a slider mount 2 on the top thereof. The lower and upper blocks 1*a*, 1*b* may be integrally formed with each other if desired. The slider holder 1 is formed on one side thereof with a recess 5 positioned below the slider mount 2 and opening forwardly and upwardly for receiving a pull tab 4 of the slider therein. The slider holder 1 is further formed in substantially the center thereof with a slide opening 6 extending vertically and a transverse opening 7 in communication with the upper end of the vertical opening 6. The opening 7 opens to the recess 5. Slidably received within the vertical opening 6 is an L-shaped sliding member 8 for vertical movement therein. A compression spring 9 is interposed between the sliding member 8 and slider holder 1 for normally biasing the sliding member 8 downwardly. The lower end of the sliding member 8 normally rests on the upper end face of an operation rod 10 which is adapted to be moved upwardly and downwardly by an air cylinder or the like (not shown).

The upper portion of the sliding member 8 is bifurcated to define a groove 12 between the bifurcations 11, 11 for receiving a slider holding lever 13 therein. The lever 13 is pivoted to the bifurcations 11, 11 by means of a pivot pin 14 and 15 normally biased in the clockwise direction as seen in FIG. 1 by a spring 15. Formed on the top of the slider holding lever 13 is an engaging pawl 13*a* which extends from the transverse opening 7 towards the recess 5 and also formed on the side of the slider holding lever 13 opposite from the engaging pawl 13*a* is a cam face 16. The cam face 16 is adapted to engage the tapered cam face 18 on a cam 17 secured to the slider holder 1.

A fastener slider 3 is fed from a position forwardly of the slider mount 2 or the position as shown by the phantom line in FIG. 1 into the holder 1 by means of a chute or the like and set on the slider mount 2 with the pull tab 4 of the fastener slider extending vertically downwardly into the recess 5.

Figure 2:
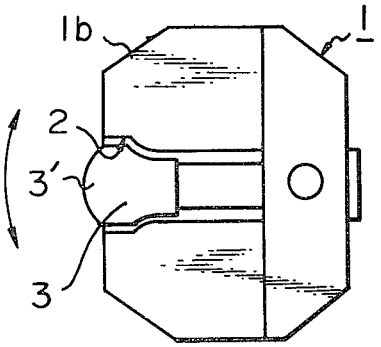
FIG. 2 is a top plan view of said device.
Figure 3:
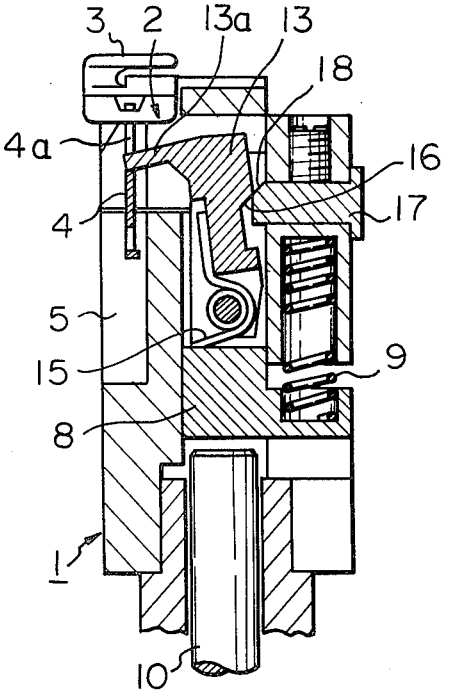
FIG. 3 is similar to FIG. 1, but shows the engaging pawl on the slider holding lever in its pull tab engaging position.
Figure 4:
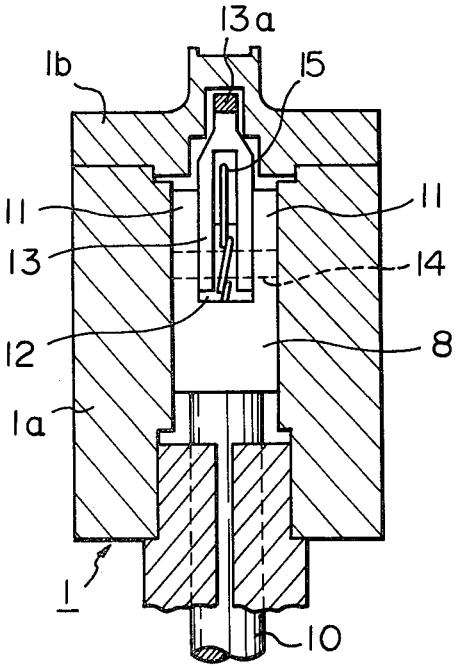
FIG. 4 is a vertically sectional view taken along substantially the line IV—IV of FIG. 1.
Figure 5:
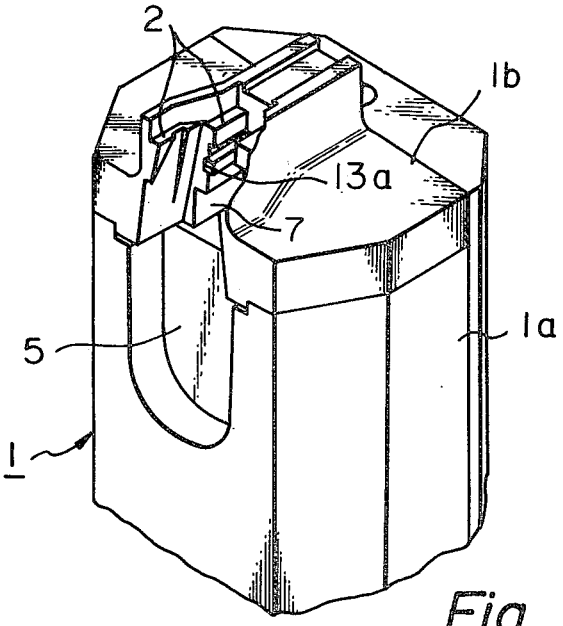
FIG. 5 is a fragmentary perspective view of the main portion of said device.

In operation, as the operation rod 10 is lowered by the cylinder, the sliding member-slider holding lever assembly 8, 13 is also lowered under the action of the compression spring 9. Simultaneously with the commencement of the downward movement of the sliding member-slider holding lever assembly 8, 13, the cam face 16 on the slider holding lever 13 is engaged and pushed by the cam face 18 on the cam 17 whereupon the slider holding lever 13 rotates or rocks in the counterclockwise direction against the force of the spring 15 to cause the engaging pawl 13*a* on the top of the lever to move downwardly so as to engage in the hole 4*a* in the slider pull tab 4. The downward movement of the engaging pawl 13*a* continues until the pawl reaches the lower end of the hole 4*a* and the cam face 16 is disengaged from the cam face 18 whereupon the pawl 13*a* pulls the slider pull tab 4 downwardly with the aid of the force of the compression spring 9 whereby the slider 3 is positively set on the slider mount 2. Although not shown, when the fastener slider is one which is provided with an automatic stop means, an engaging pawl of the stop means is pulled out of the slider guide groove by pulling the pull tab downwardly with the stop pawl removed from the chain guide groove of the slider. In this condition, the fastener chains (not shown) are threaded through the slider 3 from the shoulder end 3' of the fastener slider 3. When the slider 3 is fed into the slider holder 1 from a position forwardly of the slider mount 2 or the phantom line position as shown in FIG. 1 by means of the chute, since the chute becomes an impediment to the threading of the fastener chains through the slider, the slider holding device may be so designed that the entire device can rotate reciprocally within a horizontal plane as shown by the double-head arrow in FIG. 2. With such a design of the slider holding device, the fastener slider feed and fastener chain threading can be performed in different positions.

After the fastener chains have been threaded through the slider 3, when the cylinder is actuated so as to raise the operation rod 10, the sliding member 8 is moved upwardly against the force of the spring 9, the spring 15 returns the slider holding lever 13 to the position as shown in FIG. 1 and the engaging pawl 13*a* retracts from the pull tab 4 to thereby render the slider 3 free. Thus, when the slider 3 is pulled up together with the fastener chains, the slider assembly can be easily removed from the slider mount 2.

Figure 6:
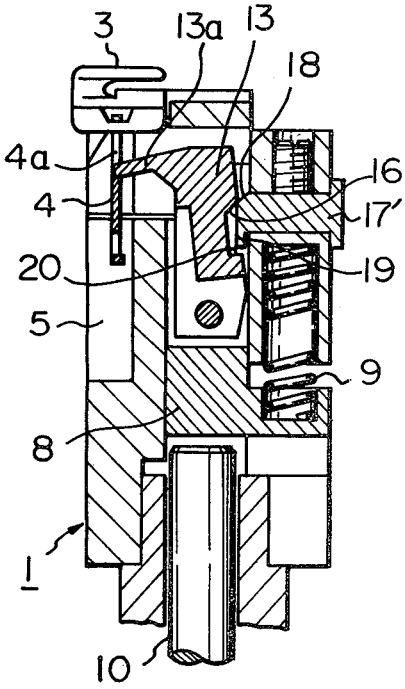
FIG. 6 is a view similar to FIG. 3, but showing another embodiment of the present invention.
Figure 7:
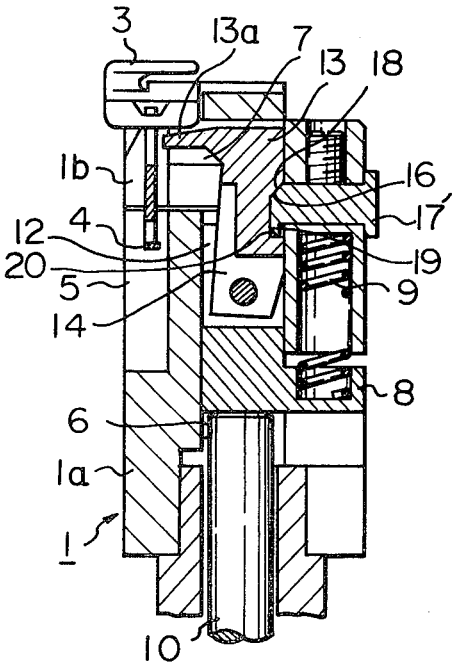
FIG. 7 is a view similar to FIG. 1, but showing the embodiment of FIG. 6.

FIGS. 6 and 7 show another embodiment of means for rocking the slider holding lever of this invention. In this embodiment, the spring 15 is eliminated and a cam 17' comprises a downward projection 19 on the opposite side of the tapered cam face 18. By this, when the sliding member 8 is moved upwardly so as to release the pull tab 7, the slider holding lever 13 is rotated in the clockwise direction by engagement between the downward projection 19 of the fixed cam 17' and a stepped portion 20 in the slider holding lever 13 so that it returns to its pull tab disengaging position (FIG. 7). Thus, the construction of the device can be made more simple.

As mentioned hereinabove, according to the present invention, since the slider receiving recess is formed in one side of the slider holder and when the slider is fed into the slider holder, the slider holding lever is retracted to a position where the lever does not engage the pull tab, the slider can be simply and easily fed into the slider holder from one side of the slider holder by means of a simple feed means such as a chute. Furthermore, after the fastener chains have been threaded through the slider, when the slider assembly is taken out of the slider holder, since the slider holding lever is retracted from the pull tab engaging position and the slider is left free, the slider assembly can be easily taken out of the slider holder by moving the fastener chains. Therefore, according to the present invention, automatic feeding and removal of the slider can be easily performed and the present invention can be advantageously applied to an automatic slider fastener processing device.

What is claimed is:

1. A fastener slider holding device comprising a fastener slider holder having a slider mount on an upper portion and a recess in a lower portion on one side thereof, a spring-loaded sliding member slidably mounted in said slider holder for upward and downward movement and normally biased downwardly, a slider holding lever rockably mounted in said slider holder and having an engaging pawl at the forward end thereof, an operation rod for moving said sliding member upwardly and downwardly and means associated with said sliding member for rocking said slider holding lever between a first position in which said engaging pawl completely disengages from a pull tab located on a slider when said slide holding lever moves upwardly and a second position in which said engaging pawl engages in the hole in said pull tab when said rocking member moves downwardly.

2. A fastener slider holding device as set forth in claim 1, wherein said last mentioned means comprises a spring for urging said slider holding lever in a direction so that said engaging pawl is disengaged from the pull tab hanging down within said recess, a cam face formed on the back side of said slider holding lever and a tapered cam face engageable with said cam face and formed on a cam secured to the slider holder.

3. A fastener slider holding device as set forth in claim 1, wherein said last mentioned means comprises a cam face and a stepped portion formed on the back side of said slider holding lever and a tapered cam face and a projection engageable with said cam face and stepped portion respectively and formed on a cam secured to the slider holder.

4. A fastener slider holding device as set forth in claim 1, wherein the upper portion of said sliding member is bifurcated to define a groove between the bifurcations, said slider holding lever being pivoted to said bifurcations within said groove.

5. A fastener slider holding device as set forth in claim 1, wherein said operation rod comprises a rod which is adapted to be moved upwardly against the spring force loaded on the sliding member.

6. A fastener slider holding device as set forth in claim 1, wherein said device is so designed that the entire device can rotate reciprocally within a horizontal plane whereby the device can move between a fastener slider feed position and a fastener chain threading position.

* * * * *